US010564599B2

(12) United States Patent
Suzuki et al.

(10) Patent No.: US 10,564,599 B2
(45) Date of Patent: Feb. 18, 2020

(54) IMAGE FORMING APPARATUS CAPABLE OF DETERMINING WHETHER TONER CARTRIDGE IS ATTACHED TO APPROPRIATE SLOT PROVIDED IN MAIN CASING

(71) Applicant: BROTHER KOGYO KABUSHIKI KAISHA, Nagoya-shi, Aichi-ken (JP)

(72) Inventors: Takashi Suzuki, Nagoya (JP); Tomoyasu Yabuki, Nagoya (JP); Tadao Kyotani, Nagoya (JP); Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/295,701

(22) Filed: Mar. 7, 2019

(65) Prior Publication Data

US 2019/0302689 A1 Oct. 3, 2019

(30) Foreign Application Priority Data

Mar. 29, 2018 (JP) ..... 2018-063383

(51) Int. Cl.
*G03G 15/00* (2006.01)
*G03G 21/18* (2006.01)

(52) U.S. Cl.
CPC ..... *G03G 21/1892* (2013.01); *G03G 15/5016* (2013.01); *G03G 21/1821* (2013.01); *G03G 21/1882* (2013.01); *G03G 2215/0697* (2013.01)

(58) Field of Classification Search
CPC ..... G03G 15/0863; G03G 15/5016; G03G 15/55; G03G 21/1821; G03G 21/1882; G03G 21/1892; G03G 2221/1823
USPC ..... 399/9, 12, 13, 31, 107, 110, 111, 113, 399/252, 258, 262
See application file for complete search history.

(56) References Cited

U.S. PATENT DOCUMENTS 8,005,392 B2 * 8/2011 Ishii ..... G03G 15/55 399/90
8,886,076 B2 * 11/2014 Sato ..... G03B 21/18 399/111
2009/0169257 A1 7/2009 Sato et al.

FOREIGN PATENT DOCUMENTS

| | | | |
|---|---|---|---|
| JP | 11-194682 | A | 7/1999 |
| JP | 2001-249589 | A | 9/2001 |
| JP | 2009-162905 | A | 7/2009 |
| JP | 2010-85797 | A | 4/2010 |
| JP | 2010-175619 | A | 8/2010 |

* cited by examiner

*Primary Examiner* — Hoan H Tran
(74) *Attorney, Agent, or Firm* — Merchant & Gould P.C.

(57) ABSTRACT

An image forming apparatus includes: a drum cartridge to which one of a first toner cartridge and a second toner cartridge is attachable; a frame including a first slot and a second slot; and a controller including a control memory and a processor. The drum cartridge to which the one of the first toner cartridge and the second toner cartridges is attached is attachable to one of the first slot and the second slot. The control memory stores first color information allocated to the first slot, and second color information allocated to the second slot. In a state where the drum cartridge is attached to one of the first slot and the second slot and when the drum memory does not store any color information, the processor is configured to perform: writing, into the drum memory, one of the first color information and the second color information which is appropriate.

15 Claims, 10 Drawing Sheets

IMAGE FORMING APPARATUS CAPABLE OF DETERMINING WHETHER TONER CARTRIDGE IS ATTACHED TO APPROPRIATE SLOT PROVIDED IN MAIN CASING

CROSS REFERENCE TO RELATED APPLICATION

This application claims priority from Japanese Patent Application No. 2018-063383 filed Mar. 29, 2018. The entire content of the priority application is incorporated herein by reference.

TECHNICAL FIELD

The present disclosure relates to an image forming apparatus.

BACKGROUND

There has been known an electro-photographic type image forming apparatus including a plurality of toner cartridges and a plurality of drum cartridges. The toner cartridges separately accommodate toner of yellow color, toner of magenta color, toner of cyan color, and toner of black color. Each of the plurality of toner cartridges is attachable to and detachable from the corresponding one of the plurality of drum cartridges. The toner cartridge is attachable to a main body of the image forming apparatus in a state where the toner cartridge is attached to the corresponding drum cartridge. This type of image forming apparatus is disclosed in, for example, the prior art.

SUMMARY

When the toner cartridge accommodating yellow toner (hereinafter referred to as "yellow toner cartridge") is, for example, desired to be replaced with a new one, the yellow toner cartridge is removed from the drum cartridge, and a new yellow toner cartridge is attached to the drum cartridge from which the used yellow toner cartridge is detached. However, there is a possibility that the toner cartridge accommodating toner of color different from color of yellow may erroneously be attached to the drum cartridge.

If such an erroneous replacement of the toner cartridge occurs, the toner of color different from yellow toner is adhered to a photosensitive drum of the drum cartridge used for yellow toner, resulting in unintended color mixture when a printing process is performed.

In view of the foregoing, it is an object of the present disclosure to provide an image forming apparatus capable of preventing unintended color mixture caused by erroneous replacement of a toner cartridge.

In order to attain the above and other objects, according to one aspect, the disclosure provides an image forming apparatus including: a drum cartridge to which one of a first toner cartridge and a second toner cartridge is attachable; a frame; and a controller. The first toner cartridge accommodates therein toner having first color. The second toner cartridge accommodates therein toner having second color different from the first color. The drum cartridge includes a photosensitive drum and a drum memory storing therein drum information relating to the photosensitive drum. The frame includes a first slot and a second slot. The drum cartridge is attachable to the first slot in a case where the one of the first toner cartridge and the second toner cartridge is attached to the drum cartridge. The drum cartridge is attachable to the second slot in the case where the one of the first toner cartridge and the second toner cartridge is attached to the drum cartridge. The controller includes a control memory and a processor. The control memory stores therein first color information and second color information. The first color information is indicative of the first color allocated to the first slot. The second color information is indicative of the second color allocated to the second slot. The drum memory is configured to store one of the first color information and the second color information as color information. The processor is configured to perform: in a state where the drum cartridge is attached to the first slot, (a1) reading information from the drum memory; (b1) determining whether the information read in the (a1) reading includes the color information; and in response to determination in the (b1) determining that the information read in the (a1) reading does not include the color information, (c1) writing, into the drum memory, the first color information stored in the control memory as the color information; and in a state where the drum cartridge is attached to the second slot, (a2) reading the information from the drum memory; (b2) determining whether the information read in the (a2) reading includes the color information; and in response to determination in the (b2) determining that the information read in the (a2) reading does not include the color information, (c2) writing, into the drum memory, the second color information stored in the control memory as the color information.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. First Embodiment

Hereinafter, an image forming apparatus 100 as an example of an image forming apparatus according to a first embodiment of the present disclosure will be described with reference to FIGS. 1 through 4.

<1-1. Configuration of Image Forming Apparatus>

Figure 1:
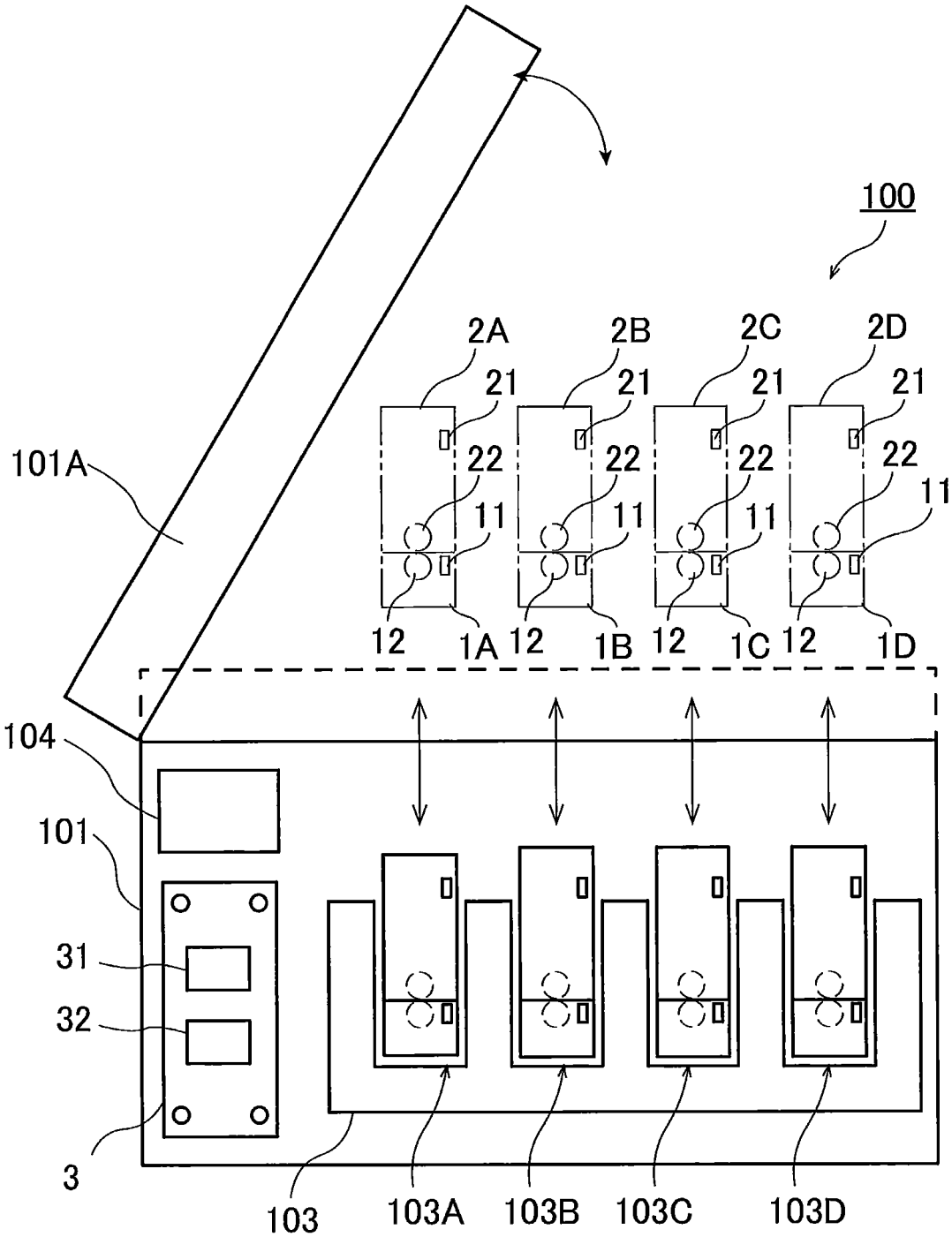
FIG. 1 is a schematic diagram of an image forming apparatus according to a first embodiment of the present disclosure.
Figure 2:
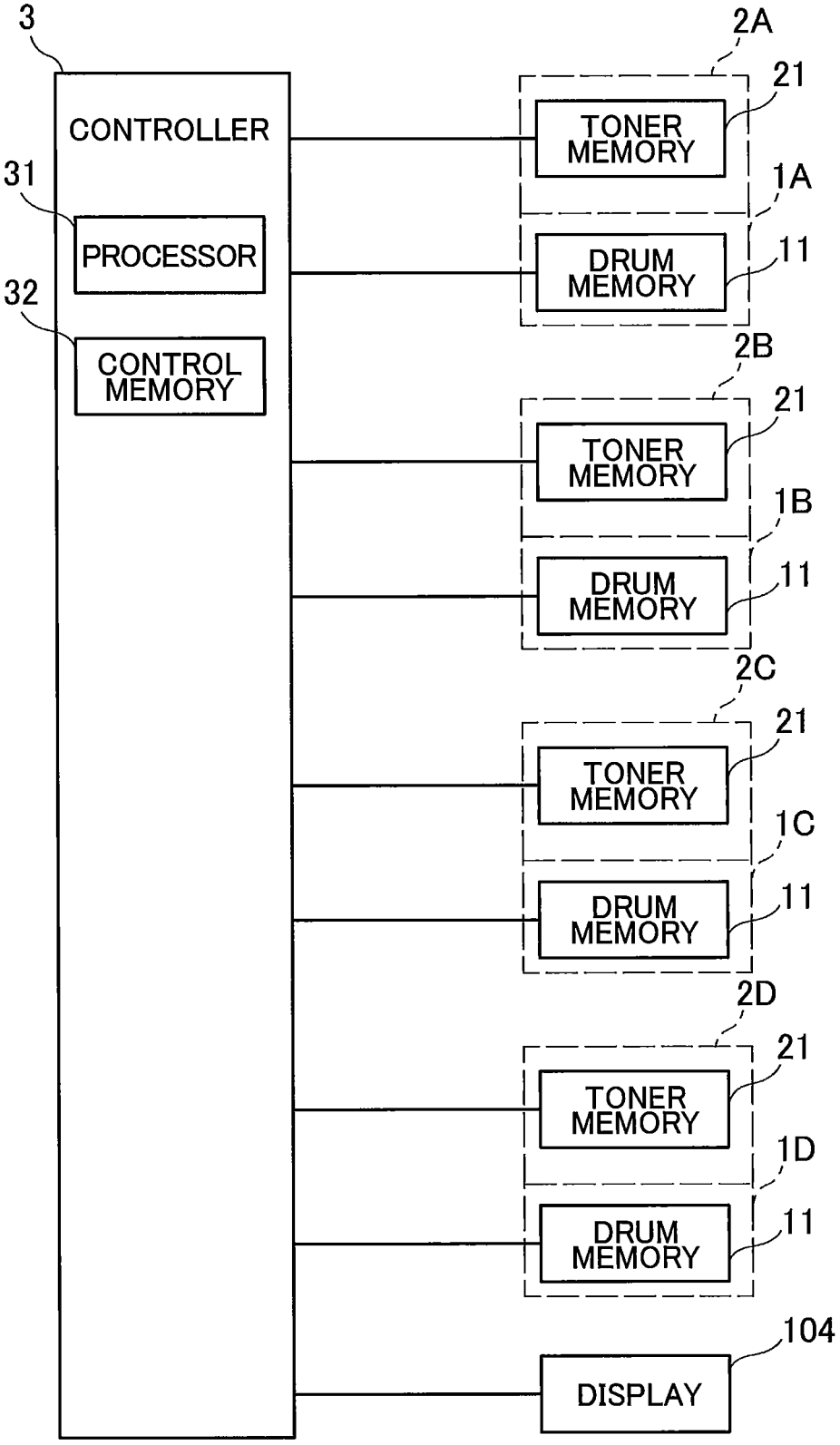
FIG. 2 is a block diagram showing an electrical connection in the image forming apparatus according to the first embodiment.

FIG. 1 is a schematic diagram illustrating the image forming apparatus 100. FIG. 2 is a block diagram illustrating electrical connection among components in the image forming apparatus 100.

The image forming apparatus 100 is an electro-photographic type printer such as a laser printer or an LED printer. As illustrated in FIG. 1, the image forming apparatus 100 includes a main casing 101, a controller 3, a plurality of drum cartridges 1A, 1B, 1C, and 1D, a plurality of toner cartridges 2A, 2B, 2C, and 2D, a frame 103, and a display 104.

In the present embodiment, the toner cartridges 2A, 2B, 2C, and 2D accommodate colors of toners (developing agent) different from one another (such as cyan, magenta, yellow and black). However, the toner cartridges 2A, 2B, 2C, and 2D may separately accommodate toners of at least two colors different from each other. For example, the toner cartridge 2A may accommodate therein toner of first color (such as cyan), and the toner cartridge 2B may accommodate therein toner of second color (such as black) different from the first color. In this case, the toner cartridges 2C and 2D may accommodate toners of either the first color or the second color. The toner cartridge 2A is an example of a first toner cartridge, and the toner cartridge 2B is an example of a second toner cartridge.

Each of the plurality of toner cartridges 2A, 2B, 2C, and 2D includes a toner memory 21 and a developing roller 22. The toner memory 21 is a storage medium from which information is readable and to which information is writable. Information stored in the toner memory 21 includes, for example, color information of the toner accommodated in the toner cartridge, an accumulated rotation amount of the developing roller 22, an amount of toner that has been used, and an error history relating to the toner cartridge. Note that, the toner memory 21 needs to store at least the color information of accommodated toner, and information other than the color information may or may not be stored in the toner memory 21.

The toner cartridges 2A, 2B, 2C, and 2D is attachable to the drum cartridges 1A, 1B, 1C, and 1D, respectively. More specifically, as illustrated in FIG. 1, the toner cartridge 2A is attachable to the drum cartridge 1A; the toner cartridge 2B is attachable to the drum cartridge 1B; the toner cartridge 2C is attachable to the drum cartridge 1C; and the toner cartridge 2D is attachable to the drum cartridge 1D.

Incidentally, any one of the toner cartridges 2A, 2B, 2C, and 2D is replaceably attachable to each of the drum cartridges 1A, 1B, 1C, and 1D. For example, the toner cartridge 2B is attachable to the drum cartridge 1A.

Each of the plurality of drum cartridges 1A, 1B, 1C, and 1D includes a drum memory 11 and a photosensitive drum 12. Each of the drum memories 11 is a storage medium to which information is writable and from which information is readable.

The drum memory 11 of each of the drum cartridges 1A, 1B, 1C, and 1D stores therein drum information relating to the corresponding drum cartridge. The drum information about each of the drum cartridges 1A, 1B, 1C, and 1D includes color information of the toner accommodated in the toner cartridge attached to the corresponding drum cartridge, a manufacturing serial number of the corresponding drum cartridge, an identification code, information indicating models to which the corresponding drum cartridge is applicable, an expected service life of the photosensitive drum 12, a charging characteristics of the photosensitive drums 12, information indicating whether the drum cartridge is new, an accumulated rotation amount of the photosensitive drum 12, an accumulated charged time of the photosensitive drum 12, the number of sheets that have been printed, and an error history.

Note that the drum memory 11 of each of the drum cartridges 1A, 1B, 1C, and 1D includes at least storage area for storing the color information of the toner. Information to be stored in the drum memory 11 of each of the drum cartridges 1A, 1B, 1C, 1D can be changed where appropriate.

In a state where each of the toner cartridges 2A, 2B, 2C, and 2D is attached to one of the drum cartridges 1A, 1B, 1C, and 1D, an outer circumferential surface of each of the photosensitive drum 12 is in contact with an outer circumferential surface of the developing roller 22 of each of the toner cartridges 2A, 2B, 2C, and 2D attached to one of the drum cartridges 1A, 1B, 1C, and 1D.

The toner accommodated in each of the toner cartridges 2A, 2B, 2C, and 2D is supplied to the outer circumferential surface of the photosensitive drum 12 of one of the drum cartridges 1A, 1B, 1C, and 1D via the developing roller 22. The toner carried onto the outer circumferential surface of the developing roller 22 is transferred from the developing roller 22 to the photosensitive drum 12 in accordance with an electrostatic latent image formed on the outer circumferential surface of the photosensitive drum 12. As a result, the electrostatic latent image formed on the outer circumferential surface of the photosensitive drum 12 becomes a visual image.

The frame 103 is accommodated within the main casing 101. The frame 103 has four slots 103A, 103B, 103C, and 103D. Each of the four slots 103A, 103B, 103C, and 103D is configured to receive one of the drum cartridges 1A, 1B, 1C, and 1D to which one of the toner cartridges 2A, 2B, 2C, and 2D is attached. In FIG. 1, the drum cartridge 1A to which the toner cartridge 2A is attached is inserted into the slot 103A; the drum cartridge 1B to which the toner cartridge 2B is attached is inserted into the slot 103B; the drum cartridge 1C to which the toner cartridge 2C is attached is inserted into the slot 103C; and the drum cartridge 1D to which the toner cartridge 2D is attached is inserted into the slot 103D. The slot 103A is an example of a first slot, and the slot 103B is an example of a second slot.

Into the slot 103A for the drum cartridge 1A to which the toner cartridge 2A is attached, the drum cartridges 1B, 1C, and 1D to which the toner cartridges 2B, 2C, and 2D are respectively attached are attachable. The same is true with respect to the other slots. Specifically, into the slot 103B for the drum cartridge 1B to which the toner cartridge 2B is attached, the drum cartridges 1A, 1C, and 1D to which the toner cartridges 2A, 2C, and 2D are attached, respectively, are attachable. Into the slot 103C for the drum cartridge 1C to which the toner cartridge 2C is attached, the drum cartridges 1A, 1B, and 1D to which the toner cartridges 2A, 2B, and 2D are respectively attached are attachable. Similarly, into the slot 103D for the drum cartridge 1D to which the toner cartridge 2D is attached, the drum cartridges 1A, 1B, and 1C to which the toner cartridges 2A, 2B, and 2C are respectively attached are attachable.

Stated differently, each of the slots 103A, 103B, 103C, and 103D is configured not to exclusively receive the right drum cartridge (the drum cartridge that should be attached to the slot) but to also receive unintended drum cartridge (the drum cartridge that should not be attached to the slot).

As illustrated in FIG. 1, the main casing 101 includes a cover 101A movable between an open position and a closed position. By moving the cover 101A to the open position, each of the drum cartridges 1A, 1B, 1C, and 1D to which the one of the toner cartridges 2A, 2B, 2C, and 2D is attached, is inserted into the slots 103A, 103B, 103C, and 103D. Note that the number of drum cartridges attachable to the slots is not limited to four but the number thereof may be two or three, or five or more. Similarly, the number of the toner cartridges attachable to the slots is not limited to four, and may be two or three, or more than five.

The controller 3 is accommodated inside the main casing 101. The controller 3 is connected the toner memory 21 of each of the toner cartridges 2A, 2B, 2C, and 2D in a state where each of the toner cartridges 2A, 2B, 2C, and 2D are attached to the main casing 101. The controller 3 includes, for example, a circuit board, a processor 31 such as a CPU, and a control memory 32 as a storage medium. The processor 31 is configured to operate in accordance with programs stored in the control memory 32 to execute various processes in the image forming apparatus 100. The control memory 32 stores programs to be retrieved by the processor 31 and information needed for executing the various processes.

The information stored in the control memory 32 includes at least information indicative of colors of toner corresponding to respective slots 103A, 103B, 103C, and 103D. Such color information may be written in the control memory 32 in the manufacturing company before shipping the image forming apparatuses.

The display 104 may be a liquid crystal display or an organic electroluminescence (EL) display, for example. The display 104 is configured to displays on its screen various kinds of information relating to operations in the image forming apparatus 100 in response to instructions received from the processor 31 of the controller 3.

<1-2. Processes Executed after Attachment of Drum Cartridges>

Figure 3:
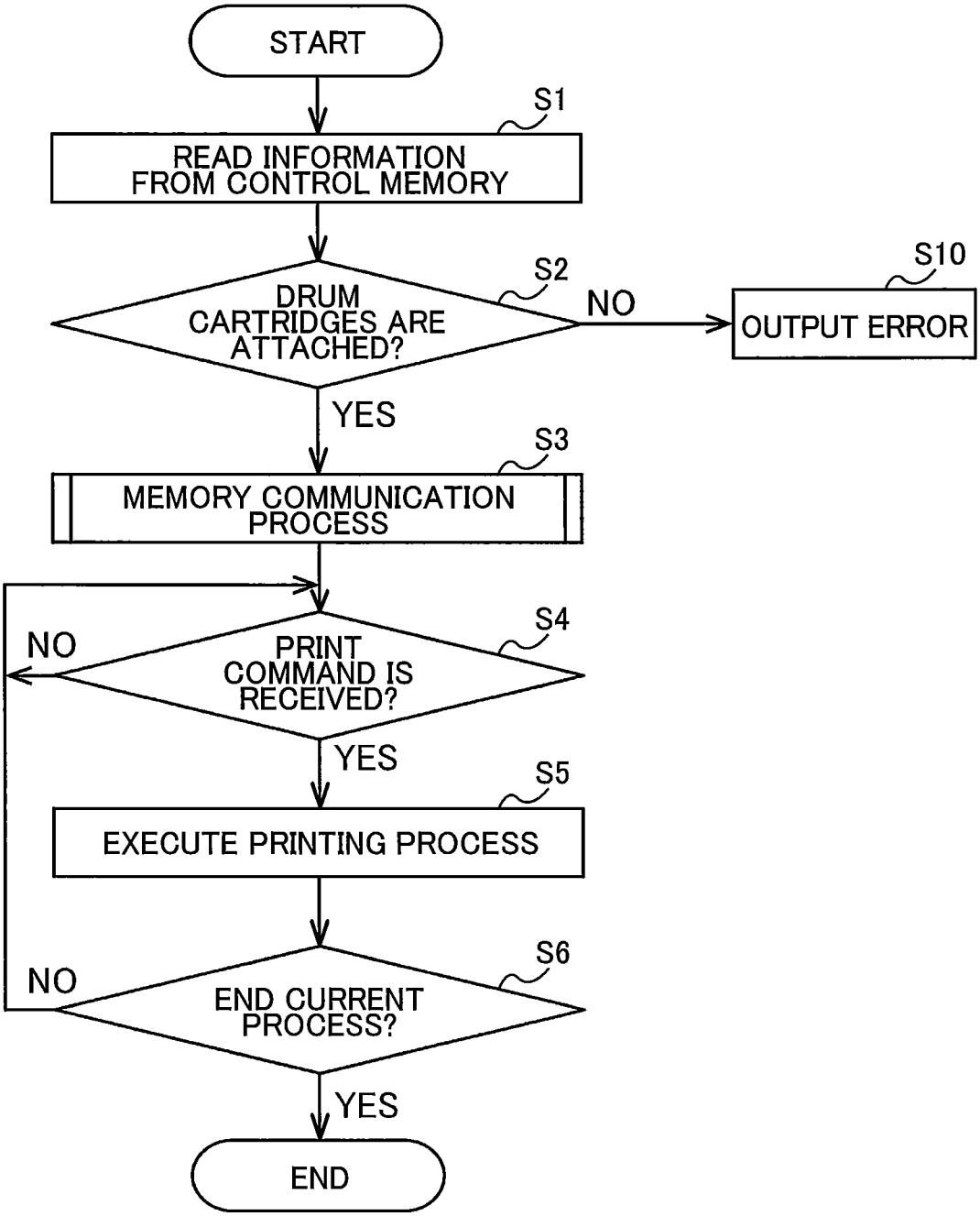
FIG. 3 is a flowchart illustrating steps in a process executed by a processor of the image forming apparatus according to the first embodiment, the process being executed after a drum cartridge to which a toner cartridge is attached is attached to a main body of the image forming apparatus.

Next, description will be made with respect to the processes executed by the processor 31 after the drum cartridges 1A, 1B, 1C, and 1D to which respective ones of the toner cartridges 2A, 2B, 2C, and 2D have been inserted into the slots 103A, 103B, 103C, and 103D formed in the frame 103. FIG. 3 is a flowchart illustrating steps in the process executed after insertion of the toner cartridges and drum cartridges into the slots. The processor 31 starts to execute the process in the flowchart of FIG. 3 at a time when the image forming apparatus 100 is powered or when the cover 101A of the main casing 101 is closed.

When the image forming apparatus 100 is powered or the cover 101A of the main casing 101 is moved to the closed position, in S1 the processor 31 of the controller 3 reads various kinds of information from the control memory 32. The information read by the processor 31 includes information about colors corresponding to the respective slots 103A, 103B, 103C, and 103D.

Next, in S2 the processor 31 determines whether all the drum cartridges 1A, 1B, 1C, and 1D are inserted into the slots 103A, 103B, 103C, and 103D of the frame 103. Determination as to whether the drum cartridges 1A, 1B, 1C, and 1D are inserted into the respective slots 103A, 103B, 103C, and 103D is made, for example, on the basis of the fact that the processor 31 is communicable with all the drum memories 11.

When the processor 31 determines that even one of the drum cartridges 1A, 1B, 1C, and 1D is not inserted into the slot (S2: NO) in S10 the processor 31 outputs an error. For example, the processor 31 displays on the display 104 an error massage indicating that the drum cartridge is not inserted into the slot.

Figure 4:
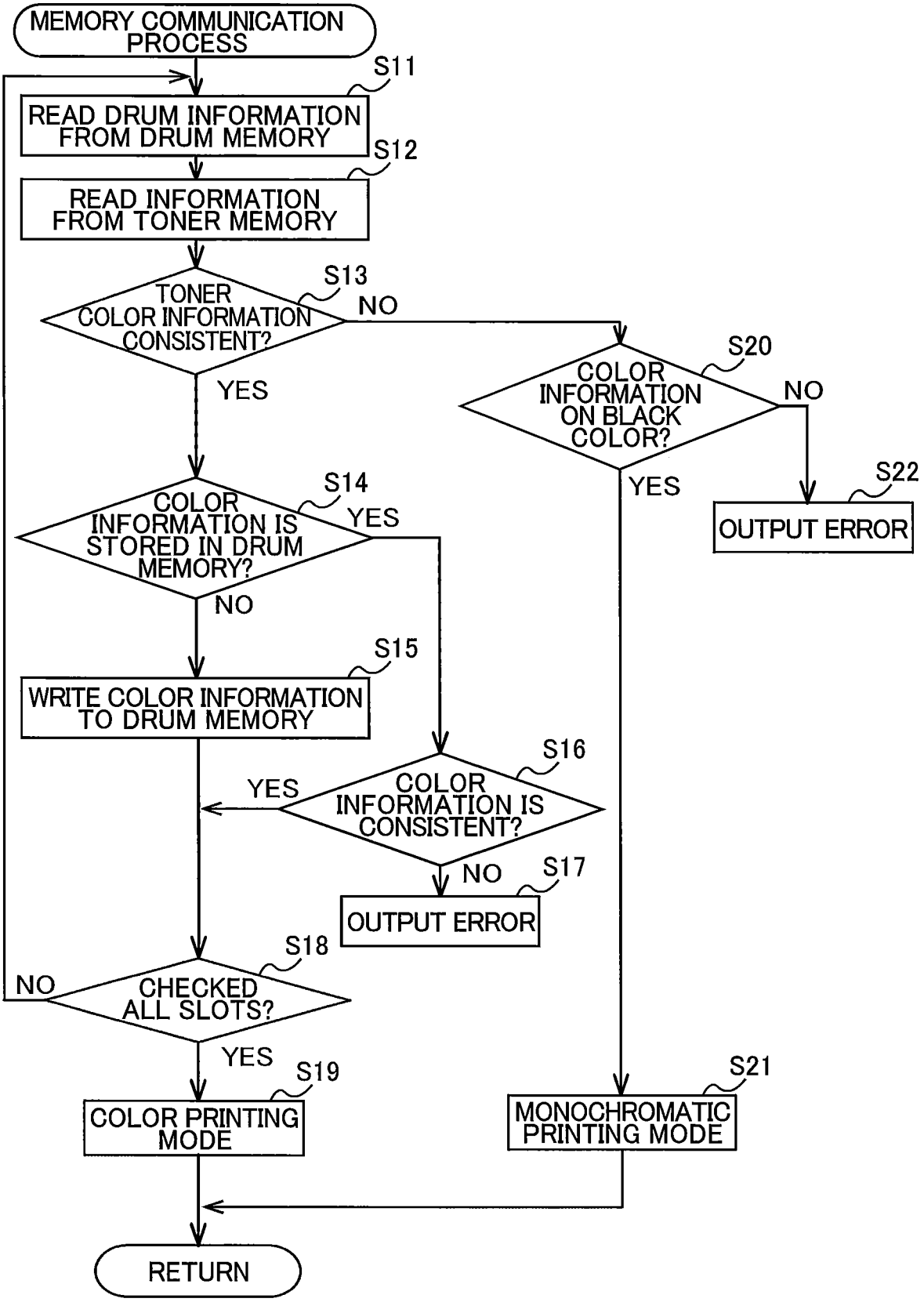
FIG. 4 is a flowchart illustrating steps in a memory communication process executed by the processor of the image forming apparatus according to the first embodiment.

When the processor 31 determines that all the drum cartridges 1A, 1B, 1C, and 1D are attached to the frame 103 (S2: YES), in S3 the processor 31 executes a memory communication process. FIG. 4 is a flowchart illustrating steps in the memory communication process. The process illustrated in FIG. 4 is executed for each of the drum cartridges 1A, 1B, 1C, and 1D and the corresponding toner cartridges 2A, 2B, 2C, and 2D inserted into the slots 103A, 103B, 103C, and 103D, respectively.

In S11, the processor 31 firstly executes a drum reading process for reading drum information from the drum memory 11 of the drum cartridge 1A. Next, in S12 the processor 31 executes a toner memory reading process for reading toner color information from the toner memory 21 of the toner cartridge attached to the drum cartridge 1A. Note that the order of executing the processes of S11 and S12 may be reversed.

Next, in S13 the processor 31 executes a toner determination process. The toner determination process is to determine whether the color information of the toner (toner color information) read from the toner memory 21 in S12 is in coincidence with the color information stored in the control memory 32. More specifically, the processor 31 determines whether the toner color information stored in the toner memory 21 of the toner cartridge inserted into the slot 103A is in coincidence with the color information of the color allocated to the slot 103A.

When the processor 31 determines that the toner color information read from the toner memory 21 is consistent with the color information stored in the control memory 32 (S13: YES), in S14 the processor 31 executes a first drum determination process of determining whether the toner color information is stored in the drum memory 11. In the first drum determination process, the processor 31 determines whether the toner color information is contained in the information read from the drum memory 11 in S11. Depending upon whether the toner color information is stored in the drum memory 11, the processor 31 determines whether the photosensitive drum 12 of the drum cartridge 1A has already been used or has not yet been used. Note that the toner determination process may be executed after executing the first drum determination process.

When the processor 31 determines that the toner color information is not stored in the drum memory 11 (S14: NO), the drum cartridge 1A has not yet been used. In such a case, in S15 the processor 31 executes a writing process of writing the toner color information into the drum memory 11. The toner color information to be stored in the drum memory 11 in the writing process is information indicative of color allocated to the slot 103A that is read in S1 from the control memory 32.

When the processor 31 determines that the toner color information is stored in the drum memory 11 (S14: YES), the drum cartridge 1A has already been used. In this case, in S16 the processor 31 executes a second drum determination process of determining whether the color information stored in the drum memory 11 is coincident with the color information stored in the control memory 32 indicative of the color allocated to the slot 103A.

When the processor 31 determines that the color information stored in the drum memory 11 is coincident with the color information indicative of the color allocated to the slot 103A (S16: YES), the processor 31 subsequently executes the process in S18. On the other hand, when the color information stored in the drum memory 11 is different from the color information indicative of the color allocated to the slot 103A (S16: NO), in S17 the processor 31 executes a drum error alerting process to alert a user of an occurrence of error. For example, the processor 31 displays on the display 104 an error message alerting that an inappropriate drum cartridge is inserted into the slot, i.e., a drum cartridge is inserted into the slot to which a color different from the color corresponding to the color information stored in the drum memory 11 is allocated. With such an error message, the user would be encouraged to correctly insert the drum cartridge into a proper slot.

The color information is written into the drum memory 11 of the drum cartridge 1A once the drum cartridge 1A has been used. The slot 103A into which the drum cartridge 1A has been inserted is allocated with the color same as the color of the drum cartridge 1A. As such, when the drum cartridge 1A or the toner cartridge 2A is replaced with a new one, new drum cartridge storing color information of different color in the drum memory 11, or new toner cartridge storing toner of different color may be inserted into the slot 103A, thereby resulting in a mixture of two different colors. Accordingly, when the determination process executed in S16 reveals that the color information stored in the drum memory 11 is not coincident with the color information indicative of the color allocated to the slot 103A, the color mixture in a printing process can be prevented by alerting a user of occurrence of the error.

Subsequently, in S18 the processor 31 determines whether the check process executed in S11 to S17 has been executed with respect to the remaining slots 103B, 103C, and 103D. When the processor 31 determines that the check process has not been executed to any one of the slots 103B, 103C, and 103D (S18: NO), the processor 31 repeatedly executes the processes of S11 and subsequent thereto with respect to any one of the remaining slots 103B, 103C, and 103D. When the processor 31 determines that the check process has been executed to all the remaining slots 103B, 103C, and 103D (S18: YES), in S19 the processor 31 sets a printing mode to a color printing mode and end the processes illustrated in FIG. 4.

On the other hand, when the processor 31 determines in the toner determination process of S13 that the color information read from the toner memory 21 and the color information stored in the control memory 32 are different from each other (S13: NO), in S20 the processor 31 subsequently determines whether the color information of black toner has been read in the processes ever executed.

More specifically, the processor 31 determines, through the processes ever executed, whether the drum cartridge including the drum memory 11 storing color information of black and the toner cartridge including the toner memory 21 storing color information of black are inserted into the slot to which the color of black is allocated. Further, the processor 31 determines whether a writing process of writing color information of black color has been executed with respect to the drum memory 11 in which color information of toner has not been written in the processes ever executed.

When the processor 31 determines that the color information of black toner has been read in the check processes ever executed (S20: YES), in S21 the processor 31 sets the printing mode to a monochromatic printing mode as the monochromatic printing is deemed to be possible, then the processor 31 ends the current process.

On the other hand, when the processor 31 determines that the color information of black toner has not been read in the check processes ever executed (S20: NO), in S22 the processor 31 alerts the user of occurrence of an error. For example, the processor 31 displays an error message on the display 104 alerting that a toner cartridge is inserted into a slot allocated with a color different from the color of toner accommodated in the inserted toner cartridge. With such an error message, the user is prompted to insert the toner cartridge into the appropriate slot.

Referring back to the flowchart illustrated in FIG. 3, after execution of the memory communication process in S3, in S4 the processor 31 determines whether a print command is received. When the processor 31 determines that no print command is received (S4: NO), the processor 31 repeats the process in S4 and waits until the print command is received. On the other hand, when the print command has been received (S4: YES), in S5 the processor 31 executes a photosensitive drum driving process of driving the photosensitive drum 12 and executes a printing process to print an image on a recording medium (such as a sheet of paper). In the printing process in S5, either monochromatic printing process or color printing process is selectively performed depending upon the printing mode set in advance.

Next, in S6 the processor 31 determines whether the processes illustrated in the flowchart of FIG. 3 are to be ended. For example, the processor 31 determines that the processes are to be ended when the image forming apparatus 100 is powered off, or the cover 101A of the main casing 101 is moved to its open position. When the processor 31 determines that the processes are to be ended (S6: YES), the processor 31 ends the processes illustrated in the flowchart of FIG. 3. On the other hand, when the processor 31 determines that the processes are not to be ended (S6: NO), the processor 31 repeatedly executes the processes of S4 and subsequent thereto until the determination in S6 is turned to YES.

As described above, by writing color information in the drum memory 11 provided in each of the drum cartridges 1A, 1B, 1C, and 1D, the processor 31 can determine whether any one of the drum cartridges 1A, 1B, 1C, and 1D is appropriately inserted into the corresponding one of the slots 103A, 103B, 103C, and 103D. Due to such a determination, inappropriate insertion of the drum cartridges 1A, 1B, 1C, and 1D into the slots 103A, 103B, 103C, and 103D allocated with different colors can be avoided, thereby preventing occurrence of color mixture when a printing process is performed.

Further, the error message displayed on the display 104 notifies the user that the drum cartridge is inappropriately inserted into the slot to which a color different from the color of the inserted drum cartridge is allocated. Such an error message prompts the user to insert the drum cartridge into the appropriate slot. Furthermore, the error message alerting that the toner cartridge is inserted into the slot allocated with different color can advise the user to insert the toner cartridge into the proper slot allocated with the same color.

Further, when the toner cartridge accommodating the toner of black color is appropriately attached to the slot allocated with the black color despite the fact that other toner cartridges are improperly attached, a monochromatic printing process can be performed and an inconvenient state in which a printing process cannot be entirely performed can be avoided.

2. Second Embodiment

Next, an image forming apparatus according to a second embodiment will be described. The second embodiment differs from the first embodiment in a timing when the color information is written into the drum memory 11 of a new drum cartridge, i.e., a drum cartridge having a drum memory 11 into which no color information about the toner has not yet been written. In the first embodiment, each time when the check process for each of the drum cartridges 1A, 1B, 1C, and 1D is executed, the color information of toner is written into the corresponding drum memory 11. In the second embodiment, after the check processes for all the drum cartridges 1A, 1B, 1C, and 1D has been completed, color information is written into the respective drum memories 11 of all the drum cartridges 1A, 1B, 1C, and 1D at once.

Also, the second embodiment differs from the first embodiment in that the monochromatic printing mode is not set. The following description is made while focusing on such differences. Description of the image forming apparatus to which the second embodiment is applied will be omitted as the configuration of the image forming apparatus according to the second embodiment is the same as the image forming apparatus according to the first embodiment.

Figure 5:
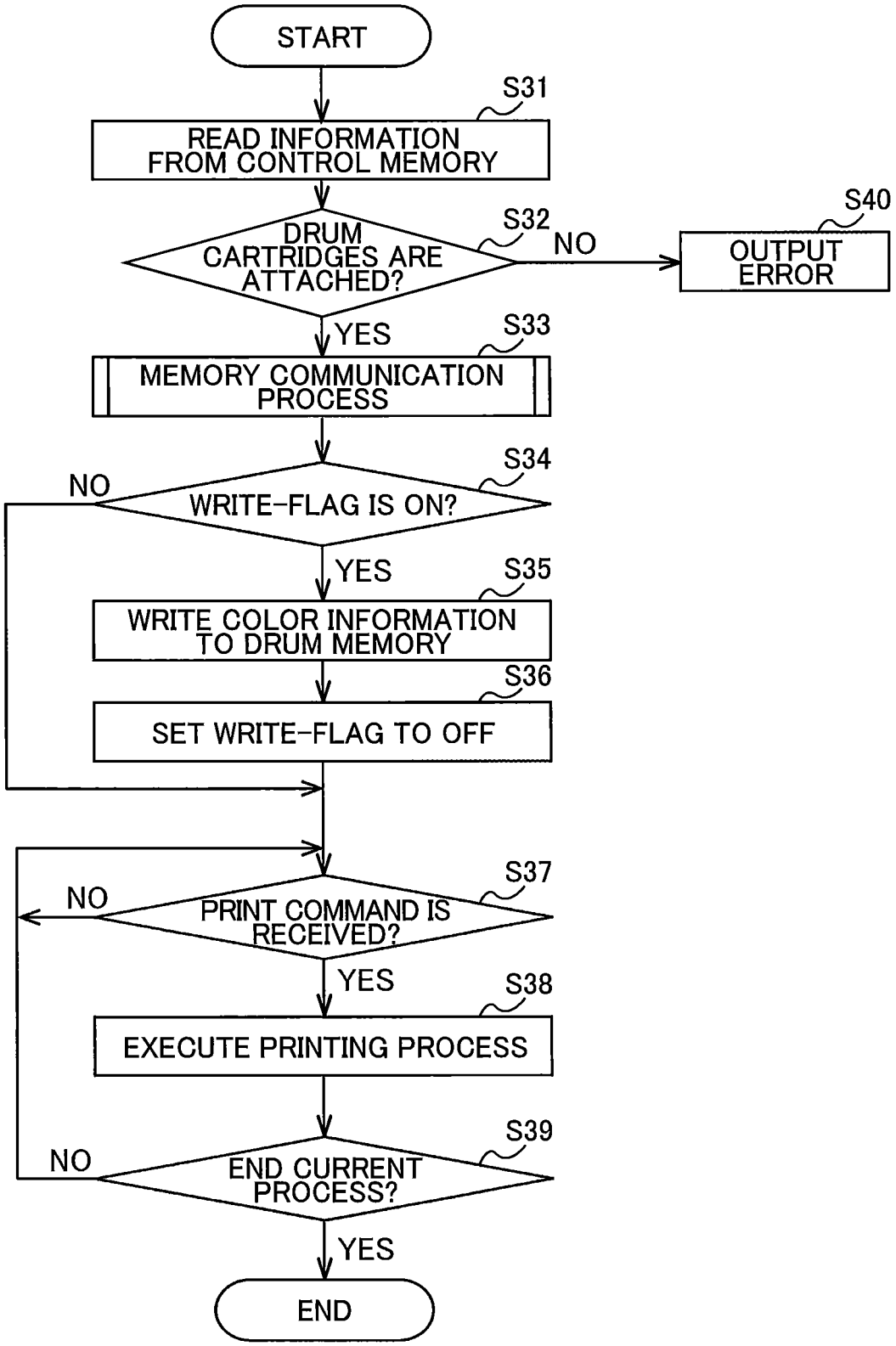
FIG. 5 is a flowchart illustrating steps in a process executed by a processor of an image forming apparatus according to a second embodiment, the process being executed after a drum cartridge to which a toner cartridge is attached is attached to a main body of the image forming apparatus.

FIG. 5 is a flowchart illustrating the processes executed after the toner cartridges and the drum cartridges are attached to the slots. Note that descriptions as to the same processes as those in the first embodiment will be omitted to avoid duplicating description.

When the cover 101A of the main casing 101 is closed or the image forming apparatus is powered, in S31 the processor 31 of the controller 3 reads various kinds of information from the control memory 32. Subsequently, in S32 the processor 31 determines whether the drum cartridges 1A, 1B, 1C, and 1D are inserted into the slots 103A, 103B, 103C, and 103D. When the processor 31 determines that at least one of the drum cartridges 1A, 1B, 1C, and 1D has not yet been set (S32: NO), in S40 the processor 31 outputs an error. For example, the processor 31 displays an error message on the display 104 alerting that the any one of the drum cartridges 1A, 1B, 1C, and 1D has not yet been attached.

Figure 6:
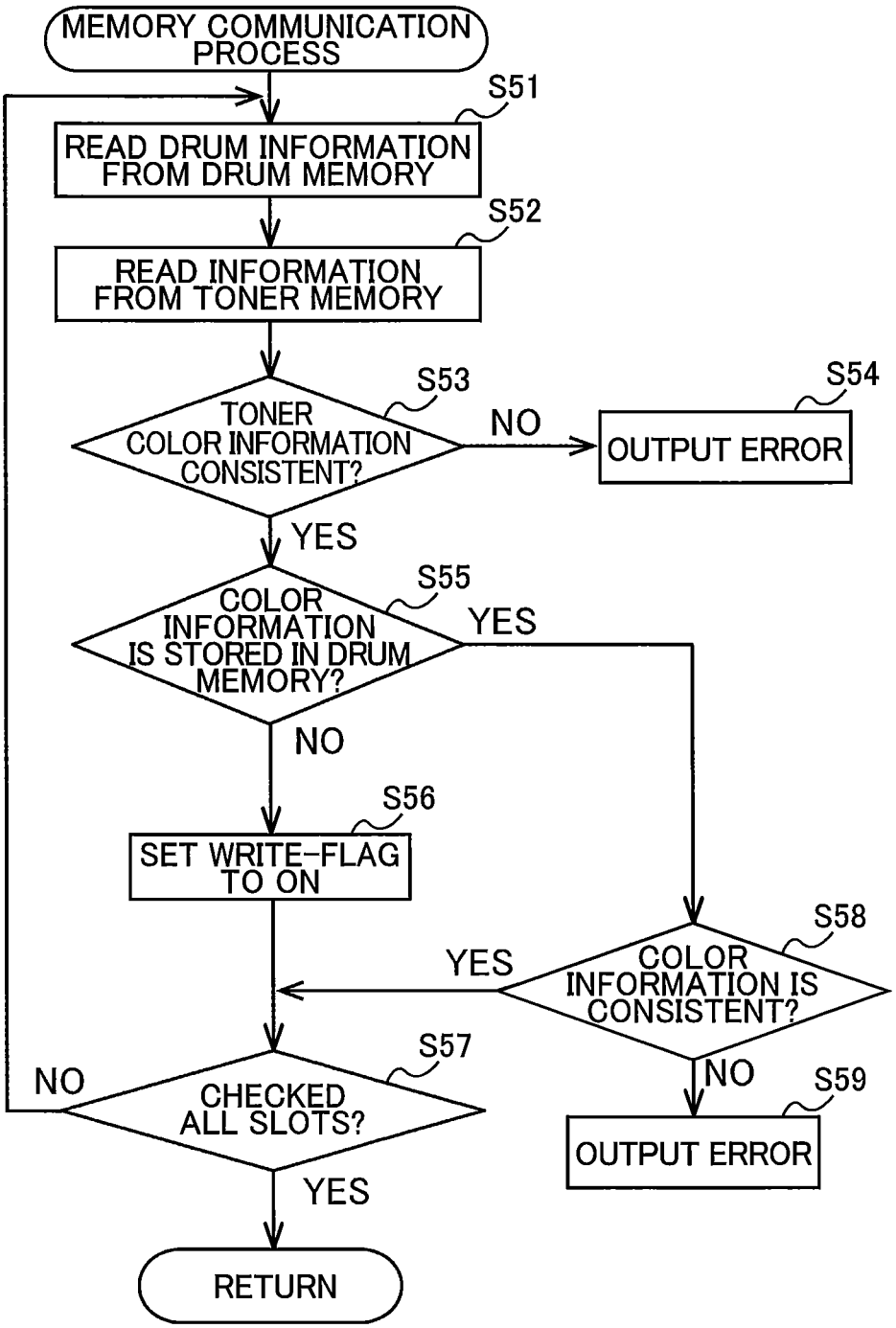
FIG. 6 is a flowchart illustrating steps in a memory communication process executed by the processor of the image forming apparatus according to the second embodiment.

When the processor 31 determines that all the drum cartridges 1A, 1B, 1C, and 1D have been attached to the respective slots 103A, 103B, 103C, and 103D (S32: YES), in S33 the processor 31 executes a memory communication process. FIG. 6 illustrates steps in the memory communication process in the form of a flowchart.

In the memory communication process, in S51 the processor 31 firstly executes a drum reading process for reading drum information from the one of the drum memories 11. Then in S52, the processor 31 subsequently executes a toner reading process of reading information from the toner memory 21 of the toner cartridge attached to the target drum cartridge. Note that the sequence of the processes of S51 and S52 can be reversed so that the process in S52 may be executed ahead of the process in S51.

Next, in S53 the processor 31 executes a toner determination process. When the processor 31 determines in the toner determination process that the color information of toner read from the toner memory 21 is not consistent with the color information stored in the control memory 32 (S53: NO), in S54 the processor 31 alerts occurrence of an error. For example, the processor 31 displays an error message on the display 104 alerting that a toner cartridge is inserted into a slot to which different color is allocated. Accordingly, the processor 31 can advise the user to reinsert the toner cartridge into the proper slot.

When the color information read from the toner memory 21 is in coincidence with the color information stored in the control memory 32 (S53: YES), in S55 the processor 31 executes a first drum determination process to determine whether the drum memory 11 stores color information. When the processor 31 determines that the color information of toner is not stored in the drum memory 11 (S55: NO), the drum cartridge is determined to be not yet used. For such drum cartridges, color information needs to be written in their own drum memories 11. To this effect, the processor 31 sets the write-flag for the drum cartridge to ON. Then, the processor 31 advances to the process in S57.

As a result of determination that the color information of toner is stored in the drum memory 11 (S55: YES), in S58 the processor 31 executes a second drum determination process to determine whether the color information stored in the drum memory 11 is in coincidence with the color information stored in the control memory 32 indicative of the color allocated to the slot 103A. When the processor 31 determines that the color information stored in the drum memory 11 and the color information of the color allocated to the slot 103A are in coincide with each other (S58: YES), the drum cartridge and the toner cartridge are determined to be properly inserted into the right slot, and therefore the processor 31 proceeds to the process in S57.

When the processor 31 determines that the color information stored in the drum memory 11 and the color information indicative of the color allocated to the slot 103A are different from each other (S58: NO), in S59 the processor 31 executes a drum error alerting process to alert the user of occurrence of an error. For example, the processor 31 displays an error message on the display 104 alerting that the drum cartridge is inserted into the slot to which different color is allocated, thereby encouraging the user to remove and reinsert the drum cartridge into the right slot.

In S57 the processor 31 determines whether the same checking process is executed with respect to each of the remaining slots 103B, 103C, and 103D. When the checking processes with respect to all the remaining slots 103B, 103C, and 103D have not yet been completed (S57: NO), the processor 31 returns to the process in S51 and repeatedly executes the processes S51 and subsequent thereto. When the processor 31 determines that the checking processes with respect to all the slots 103A, 103B, 103C, and 103D are completed (S57: YES), the processor 31 ends the processes illustrated in FIG. 6.

Referring back to the flowchart illustrated in FIG. 5, after completing the memory communication process in S33, in S34 the processor 31 determines whether the write-flag for at least one of the drum cartridges 1A, 1B, 1C, and 1D is set to ON. The write-flag is rendered ON when color information is not stored in the drum memory 11 in the memory communication process illustrated in the flowchart of FIG. 6 (S56).

When the write-flag for at least one of the drum cartridges 1A, 1B, 1C, and 1D is set to ON (S34: YES), in S35 the processor 31 executes a writing process for writing color information into the drum memory 11 of the associated drum cartridge(s). The color information read from the control memory 32 in S31 in the flowchart illustrated in FIG. 5 is written into the drum memory 11. The color information to be written in the drum memory 11 is information indicative of color allocated to the slot into which the drum cartridge is inserted. After writing the color information into the drum memory 11, in S36 the processor 31 sets the write-flags for all the drum cartridges 1A, 1B, 1C, and 1D to OFF.

When the processor 31 determines that any of the write-flags for the drum cartridges 1A, 1B, 1C, and 1D is not set to ON (S34: NO), the processor 31 advances to the process in S37 without executing the processes in S35 and S36. Note that the processor 31 also advances to the process in S37 after executing the process in S36. In S37 the processor 31 determines whether a print command has been received.

When the processor 31 determines that the print command has not yet been received (S37: NO), the process in S37 is repeatedly executed until the print command is received. When the processor 31 determines that the print command has been received (S37: YES), in S38 the processor 31 executes a photosensitive drum driving process to drive the photosensitive drum 12 to thereby execute a printing process in S38. Then, in S39 the processor 31 determines whether to end the current process. When the current process is to be ended (S39: YES), the processor 31 ends the processes in the flowchart of FIG. 5. When the processor 31 determines that the process is not to be ended (S39: NO), the processor 31 returns to the process in S37 and executes the processes in S37 and subsequent thereto.

As described above, by writing the color information into the drum memory 11, the processor 31 can determine whether the inserted drum cartridge is correctly set to the appropriate slot when the drum cartridge is removed from the slot and is reinserted to one of the slots. This configuration can prevent the drum cartridge from being inserted into the inappropriate slot and thus color mixture can be prevented when a printing process is performed.

Further, when the drum cartridge is inserted into a slot to which different color is allocated, the processor 31 controls the display 104 to display thereon an error massage to thereby prompt the user to remove the inserted drum cartridge and reinsert the same into the right slot. Also, when the toner cartridge is attached to a slot to which different color is allocated, the processor 31 displays an error massage on the display 104 so that the processor 31 can encourage the user to remove the toner cartridge and attach the same into the right slot.

3. Third Embodiment

An image forming apparatus according to a third embodiment will next be described. The third embodiment differs from the first and second embodiments with respect to a timing when color information of toner into the drum memory 11. In the third embodiment, color information is written into the drum memory 11 after a printing process is performed, i.e., an unused (new) drum cartridge has been used.

Similar to the first embodiment, the image forming apparatus according to the third embodiment has both the monochromatic printing mode and the color printing mode, and a printing process is performed based on the selected one of these two printing modes. The following description is focused on the differences of the third embodiment from the first and second embodiments. Further, since the configuration of the image forming apparatus according to the third embodiment is identical to that of the image forming apparatus 100 according to the first embodiment, the description thereof will be omitted.

Figure 7:
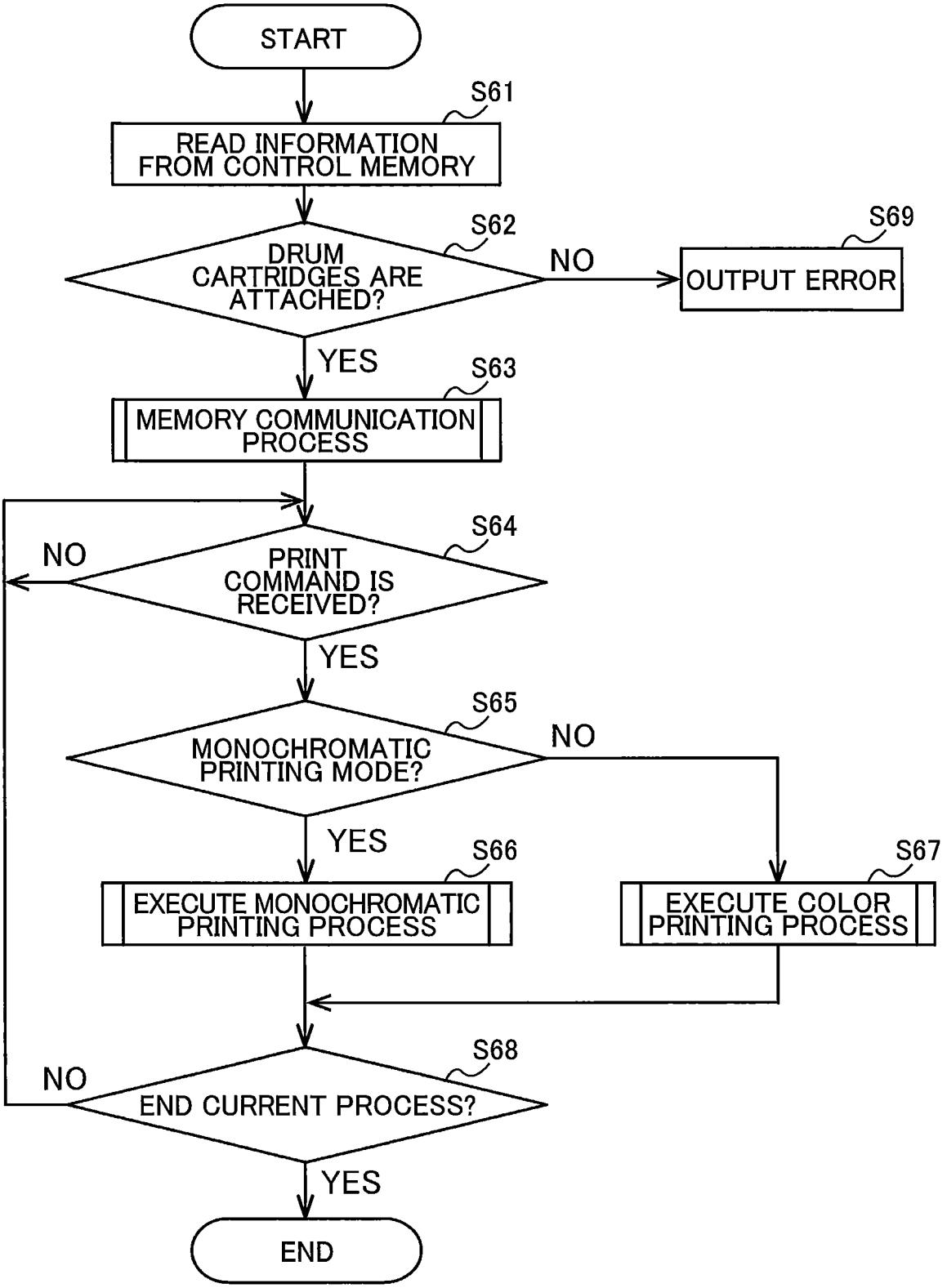
FIG. 7 is a flowchart illustrating steps in a process executed by a processor of an image forming apparatus according to a third embodiment, the process being executed after a drum cartridge to which a toner cartridge is attached is attached to a main body of the image forming apparatus.

The flowchart illustrated in FIG. 7 describes processes executed after the toner cartridges and the drum cartridges have been inserted into the slots.

After the image forming apparatus is powered or the cover 101A of the main casing 101 is closed, in S61 the processor 31 of the controller 3 reads various information from the control memory 32. Then, in S62 the processor 31 determines whether all of the drum cartridges 1A, 1B, 1C, and 1D have been inserted into respective ones of the slots 103A, 103B, 103C, and 103D.

When the determination results show that even one of the drum cartridges 1A, 1B, 1C, and 1D are not inserted into the corresponding slots 103A, 103B, 103C, and 103D (S62: NO), in S69 the processor 31 alerts the user of occurrence of an error. For example, an error message is displayed on the display 104 alerting the user that one or more drum cartridges are not attached to the slots.

Figure 8:
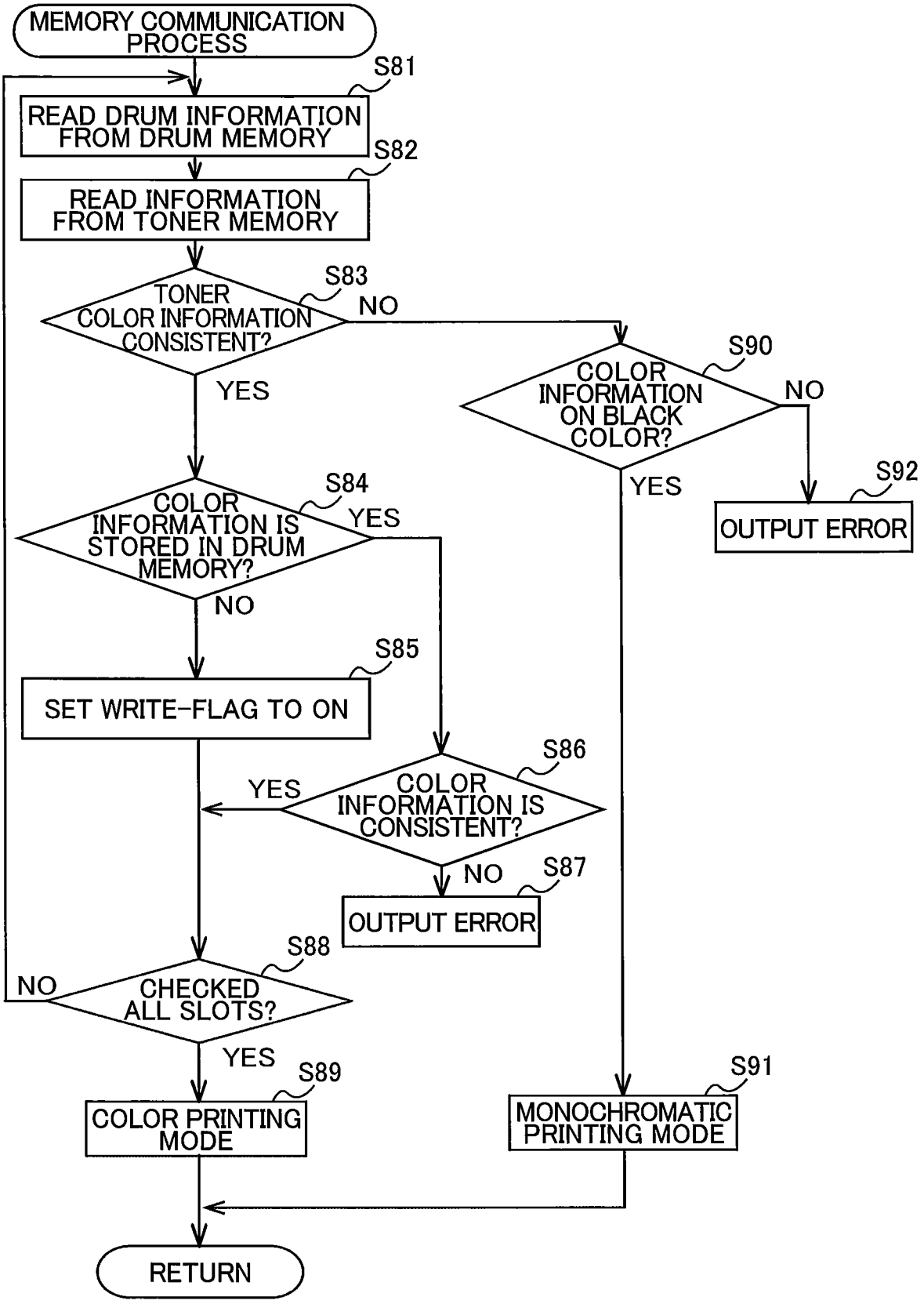
FIG. 8 is a flowchart illustrating steps in a memory communication process executed by the processor of the image forming apparatus according to the third embodiment.

When the processor 31 determines that all of the drum cartridges 1A, 1B, 1C, and 1D have been inserted into ones of the slots 103A, 103B, 103C, and 103D (S62: YES), in S63 the processor 31 executes a memory communication process. The memory communication process is illustrated in the flowchart of FIG. 8.

In S81 the processor 31 firstly executes a drum reading process of reading drum information from the drum memory 11. Subsequently, in S82 the processor 31 executes a toner reading process to read information from the toner memory 21. Note that the processes of S81 and S82 can be reversed so that the process in S82 may be executed ahead of the process in S81.

Then, in S83 the processor 31 executes a toner determination process. When the processor 31 determines that the color information of toner read from the toner memory 21 is coincident with the color information stored in the control memory 32 (S83: YES) indicative of the color allocated to the slot 103A, in S84 the processor 31 executes a first drum determination process to determine whether color information of toner is stored in the drum memory 11.

When the processor 31 determines that the color information of toner is not stored in the drum memory 11 (S84: NO), the drum cartridge is determined to be not yet used. In this case, color information needs to be written in the drum memory 11. Therefore, in S85 the processor 31 sets the write-flag for the inserted drum cartridge to ON, and advances to the process in S88.

When the processor 31 determines that the color information of toner has already been stored in the drum memory (S84: YES), the drum cartridge is already used. In this case, in S86 the processor 31 executes a second drum determination process in which the color information stored in the drum cartridge and color information stored in the control memory 32 are in coincidence with each other. The color information stored in the control memory 32 is indicative of the color allocated to the slot 103A.

When the processor 31 determines that the color information stored in the drum memory 11 and the color information indicative of the color allocated to the slot 103A are in coincidence with each other (S86: YES), the processor 31 proceeds to the process in S88. On the other hand, when the processor 31 determines that the color information stored in the drum memory 11 and the color information indicative of the color allocated to the slot 103A are not in coincidence with each other (S86: NO), in S87 the processor 31 executes a drum error alerting process for alerting the user of occurrence of an error of the drum cartridge. For example, the processor 31 displays on the display 104 an error message alerting that the drum cartridge is inserted into a slot to which different color is allocated. Such an error message can encourage the user to reinsert the drum cartridge into the appropriate slot.

In S88 the processor 31 determines whether the similar check process is executed with respect to each of the remaining slots 103B, 103C, and 103D. In a case where the processor 31 determines that the check process has not been executed with respect to even one of the remaining slots 103B, 103C, and 103D (S88: NO), the processor 31 returns to the process of S81 and repeatedly executes the processes S81 and subsequent thereto. When the processor 31 determines that the check process for all the remaining slots 103B, 103C, and 103D have been completed (S88: YES), in S89 the processor 31 sets the printing mode to a color printing mode, then ends the processes illustrated in FIG. 8.

On the other hand, when the processor 31 determines in the toner determination process that the color information read from the toner memory 21 and the color information read from the control memory 32 are not in coincidence with each other (S83: NO), in S90 the processor 31 determines whether color information of black toner was read in the processes ever executed.

When the processor 31 has ever read the color information of the black toner (S90: YES), in S91 the processor 31 sets the printing mode to a monochromatic printing mode as the monochromatic printing process can be performed, and ends the process in the flowchart of FIG. 8.

When the processor 31 has not read the color information of black color through the processes ever executed (S90: NO), in S92 the processor 31 alerts occurrence of an error. For example, the processor 31 displays an error message on the display 104 indicating that the toner cartridge is attached to a slot of different color. This error message encourages the user to reinsert the cartridge into the proper slot.

Figure 9:
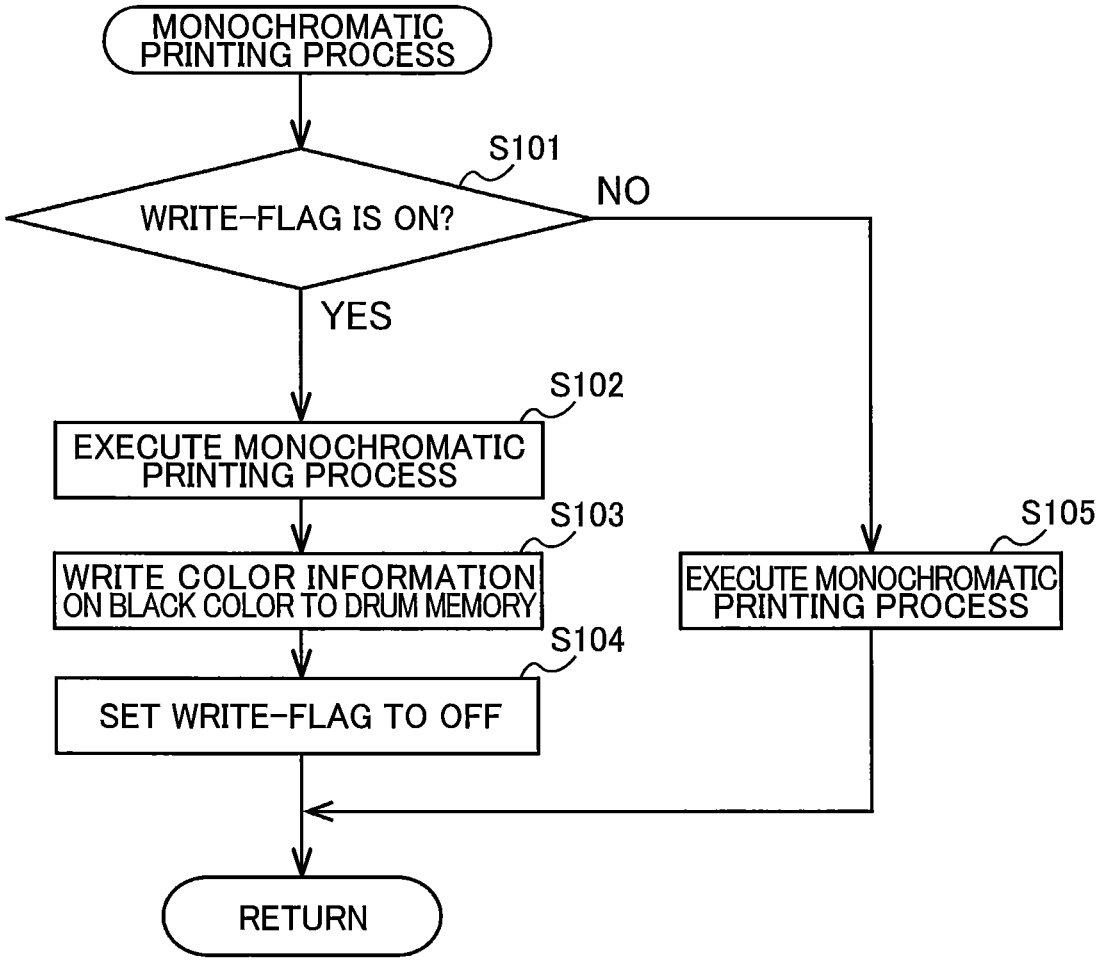
FIG. 9 is a flowchart illustrating steps in a monochromatic printing process executed by the processor of the image forming apparatus according to the third embodiment.

Referring back to the flowchart of FIG. 7, after execution of the memory communication process in S63, the processor, in S64 the processor 31 determines whether a print command has been received. When the processor 31 determines that no print command has been received (S64: NO), the process in S64 is repeatedly executed until a print command is received. When the print command has been received (S64: YES), the processor 31 determines whether the printing mode is set to the monochromatic printing mode. FIG. 9 is a flowchart illustrating steps in a monochromatic printing process.

Firstly, in S101 the processor 31 determines whether the write-flag for the drum cartridge to which the toner cartridge accommodating toner of black color is attached is set to ON. The write-flag is rendered ON when color information is not stored in the drum memory 11 in the memory communication process executed in the flowchart of FIG. 8 (S85). When the processor 31 determines that the write-flag is set to ON (S101: YES), in S102 the processor 31 executes a photosensitive drum driving process for driving the photosensitive drum 12, causing a monochromatic printing process to be performed.

Thereafter, in S103 the processor 31 executes a writing process for writing color information into the drum memory 11 of the drum cartridge. The color information to be written in the drum memory 11 is color information included in the information read from the toner memory 21 provided in the toner cartridge accommodating toner of black color. Then, in S104 the processor 31 sets the write-flag to OFF. On the other hand, when the processor 31 determines that the write-flag is not set to ON (S101: NO), in S105 the processor 31 executes the monochromatic printing process. Note that the order of execution of the processes of S102 and S103 can be reversed.

Returning to the flowchart of FIG. 7, after execution of the monochromatic printing process in S66, in S68 the processor 31 determines whether the current process is to be ended. When the processor 31 determines that the current process is to be ended (S68: YES), the processor 31 ends the processes in the flowchart of FIG. 7. On the other hand, when the current process is determined not to be ended (S64: NO), the processor 31 returns to the process in S64 and repeatedly executes the processes in S64 and subsequent thereto.

Figure 10:
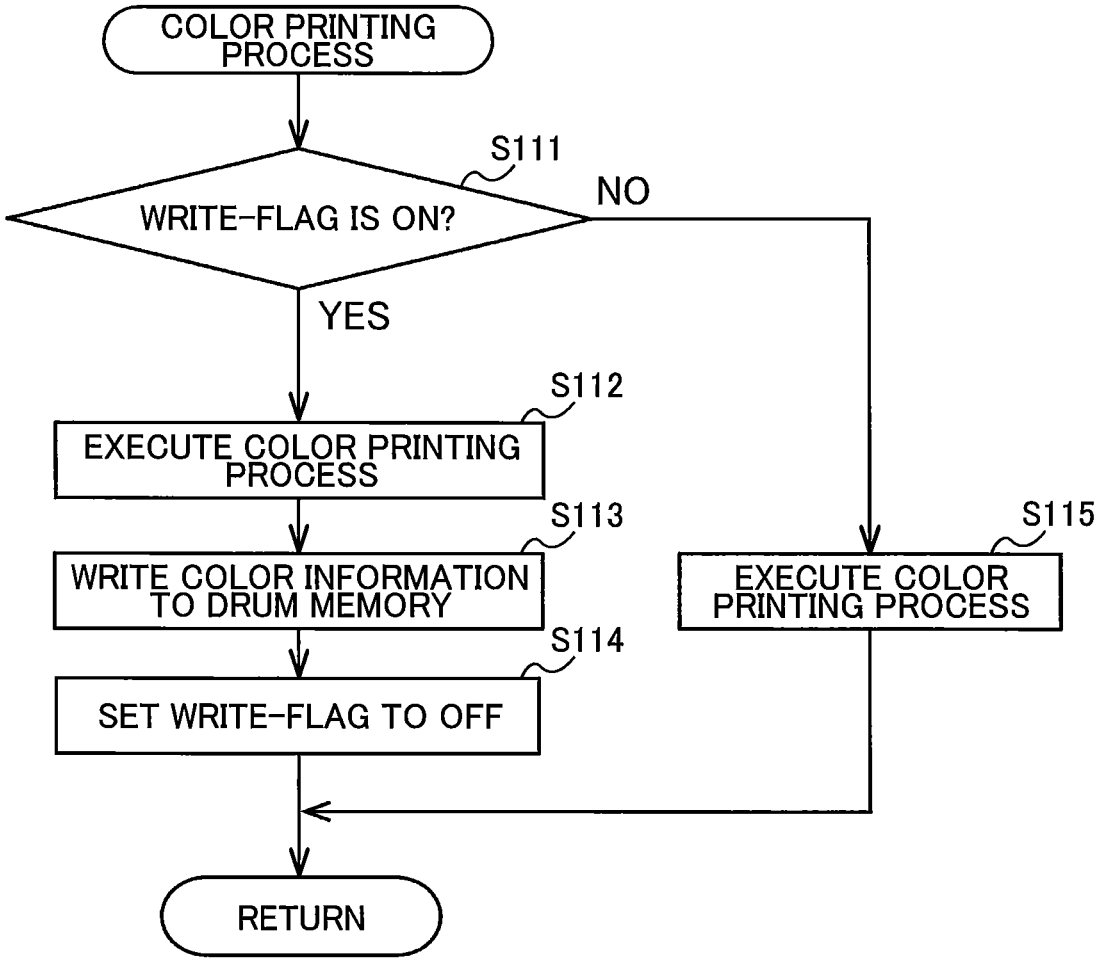
FIG. 10 is a flowchart illustrating steps in a color printing process executed by the processor of the image forming apparatus according to the third embodiment.

On the other hand, when the processor 31 determines that the printing mode is not set to the monochromatic printing mode (S65: NO), in S67 the processor 31 executes a color printing process. FIG. 10 is a flowchart illustrating steps in the color printing process.

Firstly, in S111 the processor 31 determines whether the write-flag for at least one of the drum cartridges 1A, 1B, 1C, and 1D is set to ON. When the processor 31 determines that the write-flag for at least one of the drum cartridges 1A, 1B, 1C, and 1D is set to ON (S111: YES), in S112 the processor 31 executes a photosensitive drum driving process to drive the photosensitive drum 12 to thereby cause a color printing process to be performed. After that, in S113 the processor 31 executes a writing process of writing color information into the drum memory 11. Then, in S114 the processor 31 sets the write-flags for all the drum cartridges 1A, 1B, 1C, and 1D to OFF.

On the other hand, when the processor 31 determines that the write-flag for any one of the drum cartridges 1A, 1B, 1C, and 1D is not set to ON (S111: NO), in S115 the processor 31 executes the color printing process. Note that the process in S113 may be executed before executing the process in S112.

Returning to the flowchart of FIG. 7, after executing the color printing process in S67, in S68 the processor 31 determines whether to end the process in FIG. 7.

As described above, by writing color information into the drum memory 11, the processor 31 determines whether the drum cartridge is properly attached to the appropriate slot when the drum cartridge is removed and then reinserted to the slot. Accordingly, unintentional attachment of the drum cartridge to the slot to which different color is allocated can be prevented, thereby suppressing mixture of different colors.

Further, an error message is displayed on the display 104 to alert that a drum cartridge is attached to the slot allocated with a color different from the color of the drum cartridge. Such an error message encourages the user to attach the drum cartridge to the appropriate slot. Furthermore, an error message is displayed on the display 104 to alert that a toner cartridge is attached to the slot allocated with a color different from the color of the toner cartridge. As a result, the user is encouraged to attach the toner cartridge to the appropriate slot.

Further, as the black toner cartridge is properly attached to the slot to which color of black is allocated, the monochromatic printing process can be performed and an inconvenient state in which a printing process cannot be performed can be avoided.

4. Modifications

While the description has been made with respect to specific embodiments, it would be apparent to those skilled in the art that the described embodiments are merely examples and many modifications and variations may be made thereto.

In the flowcharts depicted in the above-described embodiment, the order of execution of the processes can be changed where appropriate.

In the embodiments described above, the color information to be stored in the control memory 32 is written at a time of shipment of the image forming apparatus from the manufacturing company. However, when the toner cartridge is attached to the slot 103A for the first time, color information of toner stored in the toner memory 21 of the attached toner cartridge may be written in the control memory 32.

Further, when a printing process is executed based on the monochromatic printing mode, the user may be notified that the printing process is executed with a monochromatic printing mode, for example, by using the display 104.

While the image forming apparatus according to the second embodiment does not have the monochromatic printing mode, the monochromatic printing mode may be employed in the second embodiment. Conversely, while image forming apparatuses in the first and third embodiments employ the monochromatic printing mode, the monochromatic printing mode can be dispensed with in the first and third embodiments.

Further, various features appearing in the above-described embodiments and the modifications may be suitably combined together avoiding conflicting combination.

What is claimed is:

1. An image forming apparatus comprising:

a drum cartridge to which one of a first toner cartridge and a second toner cartridge is attachable, the first toner cartridge accommodating therein toner having first color, the second toner cartridge accommodating therein toner having second color different from the first color, the drum cartridge including a photosensitive drum and a drum memory storing therein drum information relating to the photosensitive drum;

a frame including a first slot and a second slot, the drum cartridge being attachable to the first slot in a case where the one of the first toner cartridge and the second toner cartridge is attached to the drum cartridge, the drum cartridge being attachable to the second slot in the case where the one of the first toner cartridge and the second toner cartridge is attached to the drum cartridge; and a controller including a control memory and a processor, the control memory storing therein first color information and second color information, the first color information being indicative of the first color allocated to the first slot, the second color information being indicative of the second color allocated to the second slot, the drum memory being configured to store one of the first color information and the second color information as color information, the processor being configured to perform:

in a state where the drum cartridge is attached to the first slot, (a1) reading information from the drum memory;

(b1) determining whether the information read in the (a1) reading includes the color information; and in response to determination in the (b1) determining that the information read in the (a1) reading does not include the color information, (c1) writing, into the drum memory, the first color information stored in the control memory as the color information; and in a state where the drum cartridge is attached to the second slot, (a2) reading the information from the drum memory;

(b2) determining whether the information read in the (a2) reading includes the color information; and in response to determination in the (b2) determining that the information read in the (a2) reading does not include the color information, (c2) writing, into the drum memory, the second color information stored in the control memory as the color information.

2. The image forming apparatus according to claim 1, wherein the processor is configured to further perform:

in response to the determination in the (b1) determining that the information read in the (a1) reading includes the color information, (d1) determining whether the color information stored in the drum memory is coincident with the first color information corresponding to the first slot stored in the control memory; and in response to the determination in the (b2) determining that the information read in the (a2) reading includes the color information, (d2) determining whether the color information stored in the drum memory is coincident with the second color information corresponding to the second slot stored in the control memory.

3. The image forming apparatus according to claim 2, wherein the first toner cartridge includes a toner memory storing therein toner color information, the toner color information stored in the toner memory of the first toner cartridge being first toner color information indicative of the first color, wherein the second toner cartridge includes a toner memory storing therein toner color information, the toner color information stored in the toner memory of the second toner cartridge being second toner color information indicative of the second color, and wherein, in the state where the drum cartridge is attached to the first slot, the processor is configured to further perform:

(e) reading the toner color information from the toner memory of the one of the first toner cartridge and the second toner cartridge attached to the drum cartridge; and (f) determining whether the toner color information read in the (e) reading is coincident with the first color information corresponding to the first slot stored in the control memory.

4. The image forming apparatus according to claim 3, wherein the processor is configured to perform the (d1) determining in response to determination in the (f) determining that the toner color information read in the (e) reading is coincident with the first color information corresponding to the first slot stored in the control memory, and wherein the processor is configured to further perform:

in response to determination in the (d1) determining that the color information stored in the drum memory is coincident with the first color information corresponding to the first slot stored in the control memory, executing a printing process.

5. The image forming apparatus according to claim 4, wherein the processor is configured to further perform:

in response to the determination in the (d1) determining that the color information stored in the drum memory is different from the first color information corresponding to the first slot stored in the control memory, (g) alerting occurrence of a drum attachment error.

6. The image forming apparatus according to claim 5, wherein the drum attachment error indicates that the first toner cartridge is not attached to the drum cartridge attached to the first slot.

7. The image forming apparatus according to claim 5, further comprising a display, wherein the (g) alerting displays the drum attachment error on the display.

8. The image forming apparatus according to claim 4, wherein the processor is configured to further perform:

in response to determination in the (f) determining that the toner color information read in the (e) reading is different from the first color information corresponding to the first slot stored in the control memory, (h) alerting occurrence of a toner attachment error.

9. The image forming apparatus according to claim 8, wherein the toner attachment error indicates that the first toner cartridge is not attached to the first slot to which the first color is allocated.

10. The image forming apparatus according to claim 8, further comprising a display, wherein the (h) alerting displays the toner attachment error on the display.

11. The image forming apparatus according to claim 3, wherein the first color is indicative of a color of black, the second color being indicative of a color other than black, wherein, in the state where the drum cartridge is attached to the first slot, the processor is configured to perform the (d1) determining in response to determination in the (f) determining that the toner color information read in the (e) reading is coincident with the first color information corresponding to the first slot stored in the control memory, and wherein, in response to determination in the (d1) determining that the color information stored in the drum memory is coincident with the first color information corresponding to the first slot stored in the control memory, the processor is configured to further perform:

(i) executing at least monochromatic printing process.

12. The image forming apparatus according to claim 11, further comprising another drum cartridge to which one of another first toner cartridge and another second toner cartridge is attachable, the another first toner cartridge accommodating therein toner having the first color, the another second toner cartridge accommodating therein toner having the second color, the another drum cartridge including another photosensitive drum and another drum memory storing therein drum information relating to the another photosensitive drum, wherein the another drum cartridge is attachable to the first slot in a case where the one of the another first toner cartridge and the another second toner cartridge is attached to the another drum cartridge, the another drum cartridge being attachable to the second slot in the case where the one of the another first toner cartridge and the another second toner cartridge is attached to the another drum cartridge, and wherein the processor is configured to further perform:

in a state where the drum cartridge is attached to the first slot and the another drum cartridge is attached to the second slot, (d3) determining whether the color information stored in the another drum memory is coincident with the second color information corresponding to the second slot stored in the control memory; and in response to the determination in the (d1) determining that the color information stored in the drum memory is coincident with the first color information corresponding to the first slot stored in the control memory and in response to determination in the (d3) determining that the color information stored in the another drum memory is not coincident with the second color information corresponding to the second slot stored in the control memory, (j) executing only the monochromatic printing process; and in a state where the another drum cartridge is attached to the first slot and the drum cartridge is attached to the second slot, (d4) determining whether the color information stored in the another drum memory is coincident with the first color information corresponding to the first slot stored in the control memory; and in response to determination in the (d4) determining that the color information stored in the another drum memory is coincident with the first color information corresponding to the first slot stored in the control memory and in response to determination in the (d2) determining that the color information stored in the drum memory is not coincident with the second color information corresponding to the second slot stored in the control memory, the (j) executing only the monochromatic printing process.

13. The image forming apparatus according to claim 11, further comprising another drum cartridge to which one of another first toner cartridge and another second toner cartridge is attachable, the another first toner cartridge accommodating therein toner having the first color, the another second toner cartridge accommodating therein toner having the second color, the another drum cartridge including another photosensitive drum and another drum memory storing therein drum information relating to the another photosensitive drum, wherein the another drum cartridge is attachable to the first slot in a case where the one of the another first toner cartridge and the another second toner cartridge is attached to the another drum cartridge, the another drum cartridge being attachable to the second slot in the case where the one of the another first toner cartridge and the another second toner cartridge is attached to the another drum cartridge, and wherein the processor is configured to further perform:

in a state where the drum cartridge is attached to the first slot and the another drum cartridge is attached to the second slot, (d3) determining whether the color information stored in the another drum memory is coincident with the second color information corresponding to the second slot stored in the control memory; and in response to the determination in the (d1) determining that the color information stored in the drum memory is coincident with the first color information corresponding to the first slot stored in the control memory and in response to determination in the (d3) determining that the color information stored in the another drum memory is coincident with the second color information corresponding to the second slot stored in the control memory, (k) executing selective one of color printing process and the monochromatic printing process; and in a state where the another drum cartridge is attached to the first slot and the drum cartridge is attached to the second slot, (d4) determining whether the color information stored in the another drum memory is coincident with the first color information corresponding to the first slot stored in the control memory; and in response to determination in the (d4) determining that the color information stored in the another drum memory is coincident with the first color information corresponding to the first slot stored in the control memory and in response to determination in the (d2) determining that the color information stored in the drum memory is coincident with the second color information corresponding to the second slot stored in the control memory, the (k) executing selective one of the color printing process and the monochromatic printing process.

14. The image forming apparatus according to claim 1, wherein the processor is configured to further perform:

(l) driving the photosensitive drum, and wherein the processor is configured to perform the (c1) writing and the (c2) writing after performing the (l) driving.

15. The image forming apparatus according to claim 1, wherein the processor is configured to further perform:

in response to receiving a print command, (m) starting a printing process in which an image is printed on a recording medium, and wherein the processor is configured to perform the (c1) writing and the (c2) writing after performing the (m) starting.

* * * * *